US005201183A

United States Patent [19]

Ramos

[11] Patent Number: 5,201,183

[45] Date of Patent: Apr. 13, 1993

[54] COOLING DEVICE FOR BEVERAGE CANS

[76] Inventor: John F. Ramos, P.O. Box 607, Double Bay, NSW 2028, Australia

[21] Appl. No.: 875,662

[22] Filed: Apr. 29, 1992

[51] Int. Cl.[5] ..... F25D 3/10; F25D 5/00

[52] U.S. Cl. ..... 62/4; 62/294; 62/457.9

[58] Field of Search ..... 62/4, 293, 294, 457.9

[56] References Cited

U.S. PATENT DOCUMENTS

| | | | |
|---|---|---|---|
| 1,897,723 | 2/1933 | Free | 62/294 |
| 3,326,013 | 6/1967 | Jacobs | 62/294 |
| 3,597,937 | 8/1971 | Parks | 62/294 |
| 3,636,726 | 1/1972 | Rosenfeld et al. | 62/294 |
| 3,759,060 | 9/1973 | Chase | 62/294 |
| 3,842,617 | 10/1974 | Chase et al. | 62/294 |
| 4,628,703 | 12/1986 | Kim | 62/294 |
| 4,736,599 | 4/1988 | Siegel | 62/530 X |
| 5,063,754 | 11/1991 | Chou | 62/294 X |

FOREIGN PATENT DOCUMENTS

| | | | |
|---|---|---|---|
| 322802 | 2/1903 | France | 62/293 |
| 513015 | 2/1921 | France | 62/294 |
| 8702123 | 4/1987 | World Int. Prop. O. | 62/294 |

*Primary Examiner*—Henry A. Bennet
*Assistant Examiner*—Christopher B. Kilner
*Attorney, Agent, or Firm*—John P. McGonagle

[57] ABSTRACT

A cooling system inside a beverage can bottom which is activated by pressing a bubble or combination or bubbles formed in the top of the can. The bubbles are internally connected to pin rods interconnected to one or more capsules located in the bottom of the can. The capsules contain a gas, usually in a liquid form such as liquid nitrogen or air. Pressure on a bubble causes the pin rod to activate a capsule or capsules thereby releasing gas into a closed loop plate system positioned within the can. The gas is of a type which causes the plate system to cool, thereby cooling the beverage in contact with the plate system.

11 Claims, 4 Drawing Sheets

COOLING DEVICE FOR BEVERAGE CANS

BACKGROUND OF THE INVENTION

This invention relates generally to cooling devices, and more particularly to a device for cooling a beverage in a container by means of an action or combined actions followed by a reaction or simultaneous reactions which flow in a closed system cycle without the need of any previous cooling by refrigeration.

SUMMARY OF THE INVENTION

Broadly speaking the invention comprises a cooling system inside a beverage can bottom which is activated by pressing a bubble or combination or bubbles formed in the top of the can. The bubbles are internally connected to pin rods interconnected to one or more gas capsules located in the bottom of the can. The gas capsules contain a gas, usually in a liquid form such as liquid nitrogen or air. Pressure on a bubble causes the pin rod to activate a capsule or capsules thereby releasing gas into a closed loop plate system positioned within the can. The gas is of a type which causes the plate system to cool, thereby cooling the beverage in contact with the plate system.

This together with other objects of the invention, along with various features of novelty which characterize the invention, are pointed out with particularity in the claims annexed hereto and forming a part of the disclosure. For a better understanding of the invention, its operating advantages and the specific objects attained by its use, reference should be had to the accompanying drawings and descriptive matter in which there is illustrated a preferred embodiment of the invention.

DETAILED DESCRIPTION OF THE INVENTION

Figure 2:
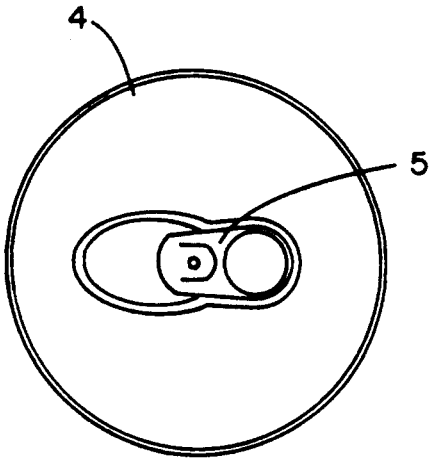
FIG. 2 PRIOR ART
FIG. 2 is a top plan view thereof.
Figure 1:
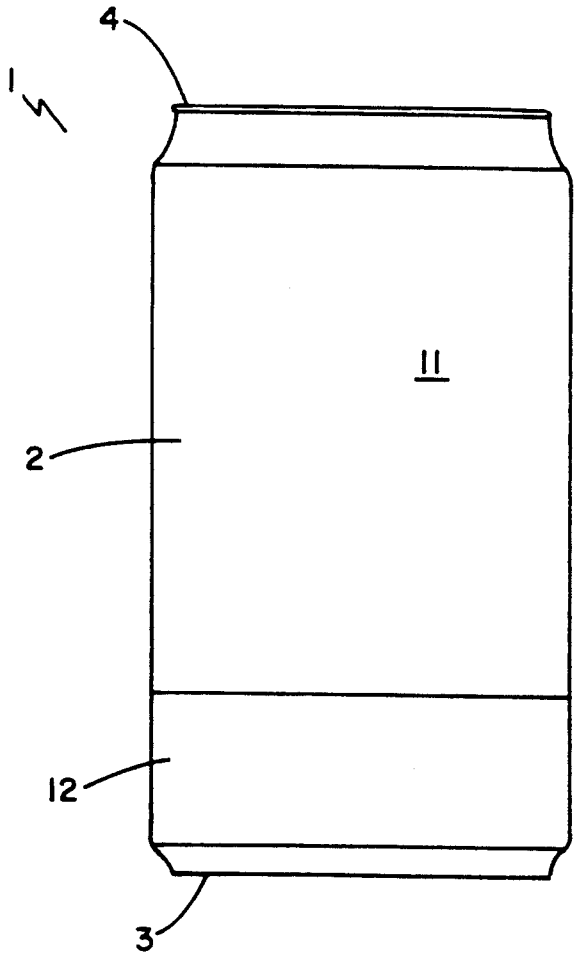
FIG. 1 PRIOR ART
FIG. 1 is a side elevational view of a conventional beverage can.
Figure 3:
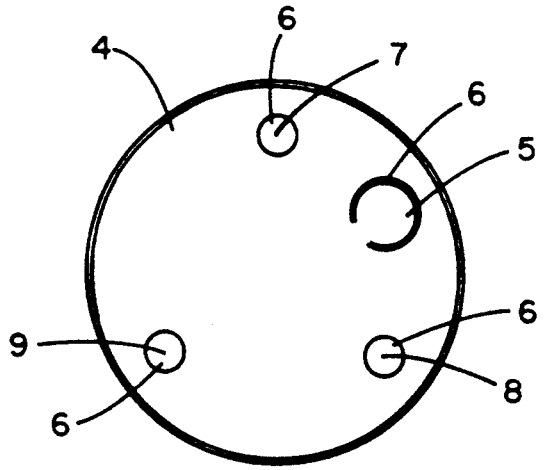
FIG. 3 is a top plan view of a beverage can modified in accordance with the instant invention.
Figure 4:
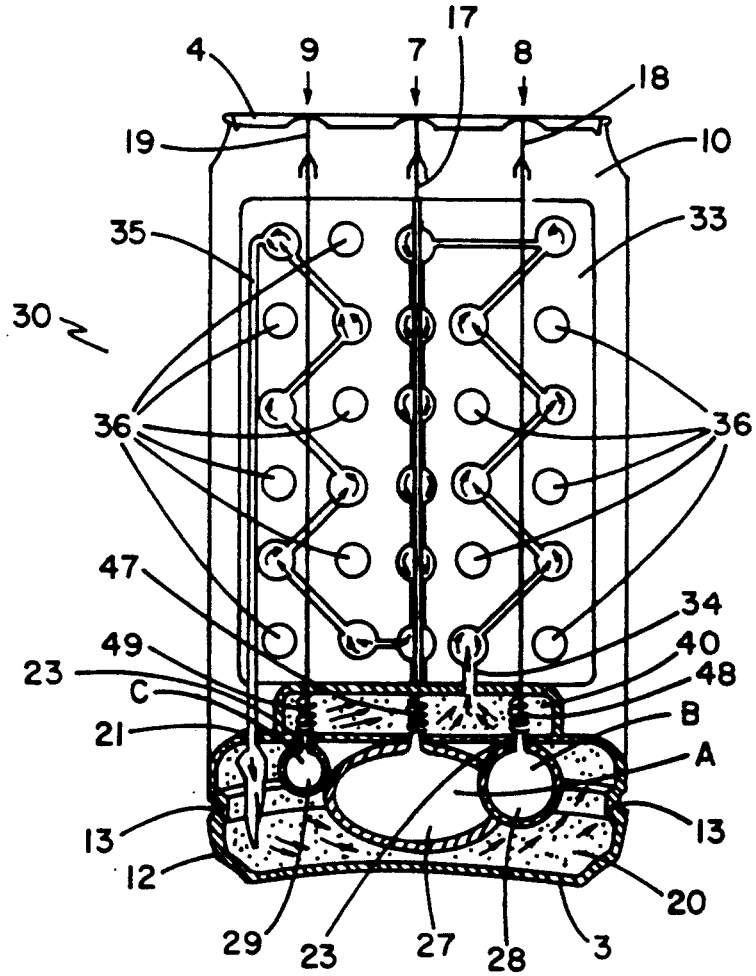
FIG. 4 is a cross-sectional view of the can of FIG. 1 modified in accordance with the instant invention.
Figure 5:
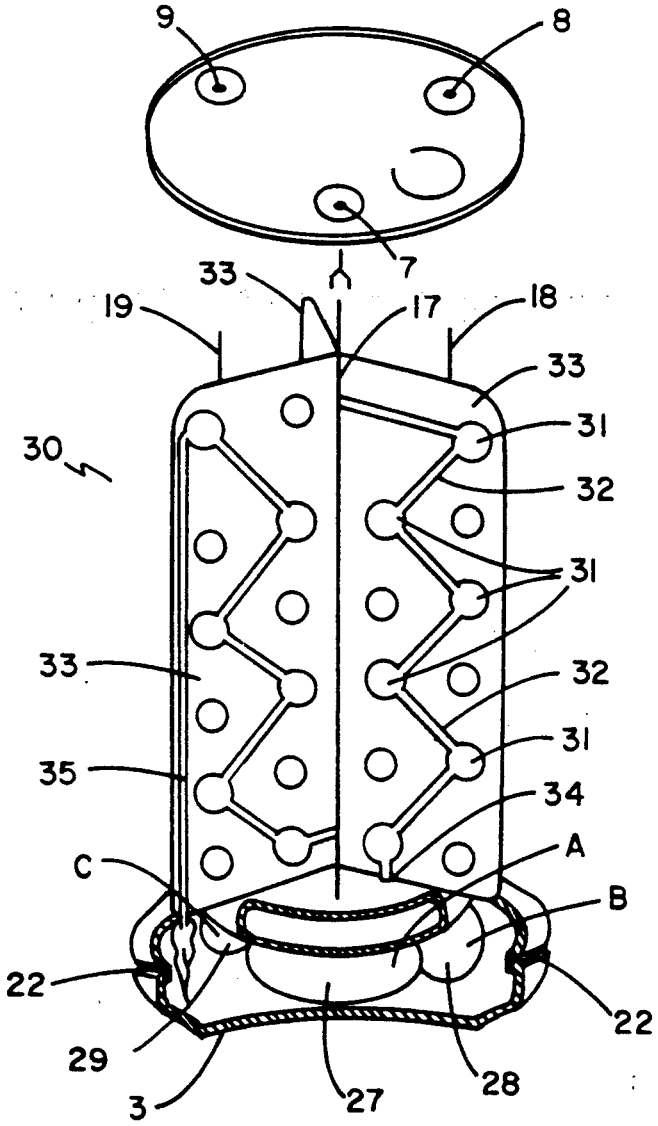
FIG. 5 is a perspective view of the instant invention, partly in section.
Figure 6:
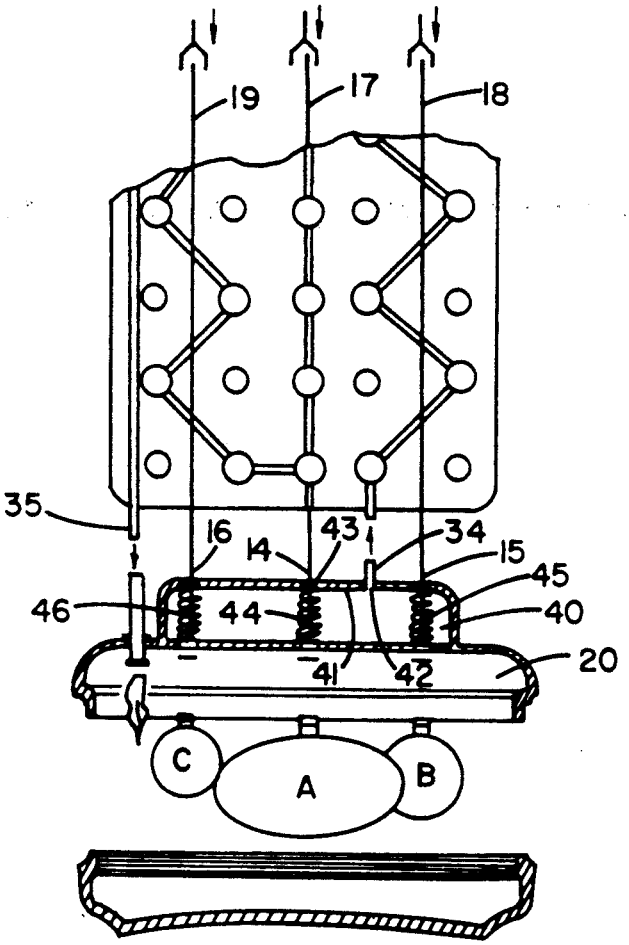
FIG. 6 is a side elevational view of the lower portion of the invention, partly exploded and partly in section.

Referring to the drawings in detail wherein like elements are indicated by like numerals, there is shown in FIGS. 1 and 2 a conventional beer or soda can 1 having an elongated cylindrical body 2, a bottom 3 and a top 4 with a conventional pull ring opener 5 on the top 4 of the can 1. FIG. 3 illustrates the top 4 of a beverage can 1 constructed according to the principles of the present invention. The can 1 in this embodiment is opened by pressing a ring 5 with circular breaking groove 6, thereby forming an opening in the can top 4. Three bubbles 7, 8 and 9, each with circular breaking grooves 6 are also formed in the top 4 of the can 1. As may be more clearly seen from FIGS. 4–6, the bubbles 7, 8 and 9 are each connected to a corresponding pin rod 17, 18 and 19 located within the can's interior 10. Each pin rod 17, 18, 19 has a longitudinal axis coincident with the longitudinal axis of the can 1 and extends interiorly from the can top 4 to a bottom chamber 20 in the can's interior 10.

The can's interior 10 contains a plate system 30 having a plurality of spherical compartments 31 connected by enclosed channels 32 for gas flow and a plurality of individual, hermetically sealed compartments 36. The can's bottom chamber 20 is a double shell vacuum chamber containing three gas capsules 27, 28 and 29 corresponding to the bubbles 7, 8 and 9 on the top 4 of the can 1. A collection chamber 40 is formed immediately above and adjacent to the vacuum chamber 20. The gas capsules 27, 28, 29 have corresponding necks 47, 48, 49 protruding from the bottom vacuum chamber 20 into the collection chamber 40. The lower ends 14, 15, 16 of the pin rods 17, 18, 19 protrude through the collection chamber wall 41 at points directly above the necks 47, 48, 49 of the gas capsules 27, 28, 29. Springs 44, 45, 46, respectively, interconnect each pin rod lower end 14, 15, 16, respectively, with the necks 47, 48, 49 of the gas capsules 27, 28, 29. A seal 43 is positioned about each pin rod 17, 18, 19 at the collection chamber wall to provide a gas-tight seal. An "O" ring seal 23 is positioned about each gas capsule neck 47, 48, 49 at the junction between the vacuum chamber 20 and collection chamber 40 thereby maintaining a gas-tight seal.

The plate system 30 is comprised of three elongated metallic plates 33 extending from the collection chamber 40 nearly to the top 4 of the can's interior 10. Each plate 33 contains a plurality of spherical compartments 31 interconnected by a network of enclosed gas channels 32 and arranged so that gas will flow in a single direction from an entry channel 34 through all of the interconnected spherical compartments 31 to a return channel 35. The plate system entry channel 34 is located at the bottom of one of the plates 33 and interconnects the plate system 30 with the collection chamber 40 through an opening 42 in the collection chamber wall 41. The return channel 35 interconnects the vacuum chamber 20 with the plate system 30. The plates 33 also have a number of hermetically sealed compartments 36 containing sodium bicarbonate, the purpose of which is described in detail below. None of the activants for producing the cooling effect and absorbing heat mix with the contents of the beverage to be drunk by the consumer.

In operation, the opener 5 on the can top 4 is activated to enable liquid to flow out from the can's interior 10. The bubbles 7, 8, 9 on the can top 4 are then pressed either individually or in various combinations to activate cooling. Pressure on one or more of the bubbles 7, 8, 9 causes the bubbles' corresponding pin rods 17, 18, 19 to transmit the pressure made by a finger on a bubble to the corresponding gas capsule necks 47, 48, 49 in the collection chamber 40 thereby puncturing and releasing the gas contained in the corresponding capsules 27, 28, 29. The gas from the punctured capsules 27, 28, 29 enters the collection chamber 40 and from there enters into the plate system 30 via the plate system entry channel 34. The gas flows through the network of compartments 31 and enclosed channels 32 out through the return channel 35 and into the vacuum chamber 20. The vacuum in the bottom chamber 20 provides "draw" for the gas through the plate system 30.

The gas flows after any combination of bubbles 7, 8, 9 have been depressed thereby activating a corresponding combination of capsules 27, 28, 29 before or after the can 1 is opened. The gas flows into the collection chamber 40, and from there into the plate system 30, thereby producing pressure and forcing the gas flow to open a valve 21 between the vacuum chamber 20 and the plate system return channel 35. Opening the valve 21 causes the vacuum in the vacuum chamber 20 to suck the gas into the chamber 20 thereby keeping the valve 21 open until pressure differentials between the plate system 30 and vacuum chamber 20 neutralize. Upon neutralization being reached, the valve 21 will close.

The gas flow into the plate system 30 will cause the plates 33 to rapidly cool. This in turn will cause the liquid in contact with the plates 33 to cool. The spherical compartments 31 and interconnecting enclosed channels 32 compress and expand the gas flow for cooling the plates 33 which in turn transmit the cooling action to the beverage within the can's interior 10. The three capsules 27, 28, 29 and their method of activation provide seven potential arrangements for different temperature actions.

The plate system may also contain a number of hermetically sealed compartments 36 containing sodium bicarbonate or the like. These compartments 36 absorb any heat initially generated by the gas flow inside the enclosed channels 32 and the spherical compartments 31, as well as some heat from the beverage in the can's interior 10.

The very nature of this invention allows a person to program the cooling effect in any season or yet disregard any cooling action by having the drink natural, say in winter.

In this embodiment of the invention the gas capsule designated 27 and also referred sometimes hereafter as capsule "A" produces a gas volume sufficient to reduce an ambient temperature in the range of 20 to 24 degrees centigrade by 70%. The capsule designated 28 and also referred sometimes hereafter as capsule "B" produces a gas volume sufficient only to reduce an ambient temperature in the range of 20 to 24 degrees centigrade by 10%. The capsule designated 29 and also referred sometimes hereafter as capsule "C" produces a gas volume sufficient only to reduce an ambient temperature in the range of 20 to 24 degrees centigrade by 5%. Other embodiments may have different arrangements, including a plurality of capsules capable of producing identical gas volumes.

As stated above, the capsules A, B and C may be activated individually or in various combinations by simple manual activation through pressure on the bubbles 7, 8, 9 on the can's top 4. The desired aim of this embodiment of the invention is to reduce the beverage temperature to approximately 7 degrees centigrade. The effect of activation of the various gas capsules may be seen in the following Table 1:

| Combination | Nominal Percentage Temperature Reduction |
|---|---|
| C | 5% |
| B | 10% |
| B + C | 15% |
| A | 70% |
| A + C | 75% |
| A + B | 80% |
| A + B + C | 85% |

The capsules 27, 28, 29 are enclosed within the vacuum chamber 20. This provides superior protection and stabilization against heat radiation from the can's body 2. A plated silver ribbon 12 may also be added to the can's lower outside wall 11 to help shield and expel light radiation. It is believed that conduction of radiation provoked by ambient temperatures and by the changing seasons will have a minimal effect on the encapsulated gas because of the gas capsules location within the shielded double shell vacuum chamber 20. The double shell vacuum chamber 20 contains a peripheral, radial groove 22 which is fitted into a corresponding radial ridge 13 formed within the can s interior 10 near to the can's bottom 4. This fixes and positions the bottom chamber 20, collection chamber 40 and plate system 30 in the can's interior 10 and in relation to the can's top 4.

All cans have an almost identical shape in configuration and method of opening. The present invention does not alter the form or dimension applicable to cans, but reduces the volume of beverage contents by 20% from 375 to 300 Ml. To maintain the 375 Ml, then obviously it will require cubic volume alteration.

The cans for beverages are metallic some in aluminium and some in steel and gas capsules, plate system, pin rods, vacuum chamber can also be made in aluminium or steel.

It is understood that the above-described embodiment is merely illustrative of the application. Other embodiments may be readily devised by those skilled in the art which will embody the principles of the invention and fall within the spirit and scope thereof.

I claim:

1. A cooling system inside a beverage can having a bottom and a top for cooling the beverage contained within the can, comprising:

a vacuum chamber positioned within the can and fixed interiorly to said can's bottom;

a plurality of gas producing capsules contained within said vacuum chamber, said gas being of the type which absorbs heat;

a collection chamber formed immediately above and adjacent to said vacuum chamber within said can, said collection chamber having openings formed in conjunction with said vacuum chamber whereby said capsules protrude into said collection chamber;

a plate system having a plurality of vertical, metallic plates in contact with said beverage contained within said can, said plates having a plurality of compartments formed therein, said compartments being interconnected by a network of enclosed channels, said network having a beginning entry channel interconnecting said plate system with said collection chamber through an opening in the collection chamber and said network having a return channel interconnecting said vacuum chamber with said plate system through an opening in said vacuum chamber; and means for activating said gas producing capsules, wherein activation of said gas causes gas to flow into said collection chamber and into said network of enclosed channels within said plate system and through said return channel to said vacuum chamber, thereby cooling said plates and thereby cooling said beverage in contact with said plates.

2. A cooling system as recited in claim 1, wherein said means for activating said gas producing capsules is comprised of:

a plurality of bubbles, each with circular breaking grooves, formed in the top of the can; and a plurality of pin rods, each connected to a corresponding bubble, located within the can's interior, each said pin rod having a longitudinal axis coincident with the longitudinal axis of the can, each said pin rod extending interiorly through to said collection chamber nearly to a corresponding gas producing capsule.

3. A cooling system as recited in claim 2, wherein said gas producing capsules have corresponding necks, protruding from the said bottom vacuum chamber into said collection chamber; and said pin rods have lower ends protruding into said collection chamber at points directly above the said necks of said capsules; and each said pin rod lower end has a spring interconnecting it with a neck of a capsule;

wherein pressure on one or more of the bubbles causes the bubbles' corresponding pin rods to transmit the pressure made on a bubble to the corresponding capsule necks in the collection chamber thereby puncturing and causing the corresponding capsule to generate gas;

wherein said generated gas from the punctured capsules enters the collection chamber and from there enters into the plate system via the plate system entry channel.

4. A cooling system as recited in claim 3, wherein:

said plate system is comprised of three elongated metallic plates extending from the collection chamber nearly to the top of the can's interior, each said plate containing a plurality of spherical compartments interconnected by a network of enclosed gas channels and arranged and adapted so that gas flow is in a single direction from said entry channel through all of the interconnected spherical compartments to said return channel, said plate system entry channel being located at the bottom of one of said plates and interconnecting the plate system with the collection chamber through an opening in the collection chamber wall, and said return channel interconnecting said plate system with said vacuum chamber.

5. A cooling system as recited in claim 4, wherein:

said plates contain a plurality of hermetically sealed compartments containing a heat absorbing material.

6. A cooling system as recited in claim 5, wherein:

said heat absorbing material is sodium bicarbonate.

7. A cooling system as recited in claim 6, wherein:

said gas produced by said capsules is of the type that absorbs heat.

8. A cooling system as recited in claim 7, wherein:

said gas producing capsules contain liquid nitrogen.

9. A cooling system as recited in claim 8, further comprising:

A plated silver ribbon attached to said can's lower outside wall.

10. A cooling system as recited in claim 9, wherein:

said vacuum chamber has a double shell and a peripheral, radial groove which is fitted into a corresponding radial ridge formed within the can's interior near to the can s bottom, thereby fixing and positioning the bottom chamber, collection chamber and plate system in the can's interior and in relation to the can's top.

11. A cooling system as recited in claim 10, further comprising:

a seal is positioned about each pin rod at its junction with said collection chamber wall thereby providing a gas-tight seal; and an "O" ring seal positioned about each gas capsule neck at the junction between the vacuum chamber and collection chamber thereby maintaining a gas-tight seal.

* * * * *